US010413933B2

(12) United States Patent
Liu et al.

(10) Patent No.: US 10,413,933 B2
(45) Date of Patent: Sep. 17, 2019

(54) COATING METHOD AND COATING DEVICE

(71) Applicant: METAL INDUSTRIES RESEARCH & DEVELOPMENT CENTRE, Kaohsiung (TW)

(72) Inventors: Kuan-Chih Liu, Kaohsiung (TW); Shi-Wei Lin, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 0 days.

(21) Appl. No.: 15/829,234

(22) Filed: Dec. 1, 2017

(65) Prior Publication Data

US 2019/0168254 A1 Jun. 6, 2019

(51) Int. Cl.

| | |
|---|---|
| ***B05D 1/00*** | (2006.01) |
| ***B05D 1/28*** | (2006.01) |
| ***B05C 1/08*** | (2006.01) |

(52) U.S. Cl.

CPC ..... *B05D 1/28* (2013.01); *B05C 1/0826* (2013.01)

(58) Field of Classification Search

CPC ..... B05D 1/28

See application file for complete search history.

(56) References Cited

U.S. PATENT DOCUMENTS

| | | | | |
|---|---|---|---|---|
| 7,354,479 | B2 | 4/2008 | Ichikawa | |
| 8,304,027 | B2 | 11/2012 | Yokoyama et al. | |
| 2004/0043154 | A1* | 3/2004 | Ichikawa | B05C 1/0813 427/355 |
| 2006/0034638 | A1* | 2/2006 | Kamijo | G03G 15/104 399/237 |

FOREIGN PATENT DOCUMENTS

| | | | |
|---|---|---|---|
| CN | 204159505 | U | 2/2015 |
| EP | 1 365 287 | A1 | 11/2003 |
| EP | 1 803 502 | A2 | 7/2007 |
| EP | 2 052 787 | A2 | 4/2009 |
| JP | 2013-34980 | A | 2/2013 |
| JP | 2014-124559 | A | 7/2014 |

* cited by examiner

*Primary Examiner* — Dah-Wei D. Yuan
*Assistant Examiner* — Kristen A Dagenais-Englehart
(74) *Attorney, Agent, or Firm* — Birch, Stewart, Kolasch & Birch, LLP

(57) ABSTRACT

A coating method has a reciprocating rotating step. A wire bar is rotated at a first rotational speed for coating a film on a web. In a process of rotating the wire bar at the first rotational speed, a tangential direction of the wire bar at a connecting area between the wire bar and the web is opposite to a moving direction of the web, and then the wire bar is rotated to restore to an original position at a second rotational speed. Meanwhile, the tangential direction is changed and is same to the moving direction of the web. The second rotational speed is far faster than the first rotational speed. A coating device has a base, the wire bar disposed across the base, and a rotation adjusting module connected to the wire bar for driving the wire bar to rotate reciprocatingly.

10 Claims, 8 Drawing Sheets

COATING METHOD AND COATING DEVICE

BACKGROUND OF THE INVENTION

1. Field of the Invention

The present invention relates to a coating method and a coating device, and more particularly to a coating method and a coating device that may effectively control the coating thickness and the coating uniformity.

2. Description of Related Art

Coating by a wire bar is a common coating method. The thickness of a film coated on a web is controlled by the diameter and the density of a wire wound on the wire bar. The U.S. Pat. No. 8,304,027 discloses a single wire bar. The wire bar is fixed and is not rotated for coating a thin and uniform film. The shortcoming of the fixed type wire bar is that the speed of the coating is fast and the drying operation cannot keep up with the coating speed. The output of the coating operation cannot be controlled, causing increase of the stock of the coating operation. In addition, the space needed for the factory and the facilities and the cost of the drying operation are increased for keeping up with the coating operation.

In addition, a mixture is added into a coating liquid. The wire bar is applied to increase the uniformity of the mixture in the film.

The JP Pub No. 2013-034980 discloses a single wire bar. The moving direction of the film and the tangential direction between the wire bar and the web are the same. The thickness of the film is increased. However, the wire bar maintains a single rotating direction. An outer surface of the wire bar is completely connected to the film. The straightness and the cylindricity of the wire bar must be accurate. If the straightness and the cylindricity of the wire bar are inaccurate, the thickness of the film is not uniform.

The JP Pub. No. 2014-124559 discloses a single wire bar. The moving direction of the film is opposite to the tangential direction between the wire bar and the web. The thickness of the film is decreased. However, the wire bar maintains a single rotating direction. An outer surface of the wire bar is completely connected to the film. The straightness and the cylindricity of the wire bar must be accurate. If the straightness and the cylindricity of the wire bar are inaccurate, the thickness of the film is not uniform.

The EP Pat. No. 1365287, the EP Pat. No. 1803502, and the EP Pat. No. 2052787 disclose two wire bars. The rotating directions of the two wire bars may be same or reverse for overcoming the defect of the single wire bar. The two wire bars respectively maintain the rotating directions. An outer surface of each one of the two wire bars is completely connected to the film. The straightness and the cylindricity of the wire bar must be accurate. If the straightness and the cylindricity of the wire bar are inaccurate, the thickness of the film is not uniform.

To overcome the shortcomings, the present invention provides a coating method and a coating device to mitigate or obviate the aforementioned problems.

SUMMARY OF THE INVENTION

The objective of the invention is to provide a coating method and a coating device to solve the problems that the speed of the fixed wire bar is fast and that high precisions in straightness and the cylindricity are required for the rotating wire bar.

The coating method is for using a coating device to coat a film on a web, and the coating method has a reciprocating rotating step. A wire bar of the coating device is rotated on the web at a first rotational speed for coating the film on the web. In a process of rotating the wire bar at the first rotational speed, a tangential direction of the wire bar at a connecting area between the wire bar and the web is opposite to a moving direction of the web, and then the wire bar of the coating device is rotated to restore to an original position at a second rotational speed. In a process of rotating the wire bar at the second rotational speed, the tangential direction of the wire bar at the connecting area between the wire bar and the web is same to the moving direction of the web. The second rotational speed of the wire bar is far faster than the first rotational speed of the wire bar.

The coating device for carrying out the coating method as described has a base, the wire bar, and a rotation adjusting module. The wire bar is disposed across the base. The rotation adjusting module is disposed on the base and is connected to the wire bar for driving the wire bar to rotate reciprocatingly.

Accordingly, the wire bar driven by the rotation adjusting module can be rotated reciprocatingly. The second rotational speed of the wire bar is far faster than the first rotational speed of the wire bar. When the wire bar is rotated at the first rotational speed, the tangential direction of the wire bar at the connecting area between the wire bar and the web is opposite to the moving direction of the web. The relative speed between the wire bar and the film is increased. On the premise that the thickness of the film is controlled accurately, the coating speed of the wire bar can be decreased for controlling the output of the coating operation.

When the wire bar is rotated at the second rotational speed, the second rotational speed of the wire bar is far faster than the first rotational speed of the wire bar. The wire bar can be restored quickly and drives the ink to splash at the high speed. Compounds in the ink may be spread evenly for increasing the uniformity of the compounds in the ink. The connecting area between the wire bar and the film can be controlled by the reciprocating rotation of the wire bar. The precision requirements on the straightness and the cylindricity of the wire bar are decreased.

Other objectives, advantages and novel features of the invention will become more apparent from the following detailed description when taken in conjunction with the accompanying drawings.

DETAILED DESCRIPTION OF THE PREFERRED EMBODIMENT

Figure 5:
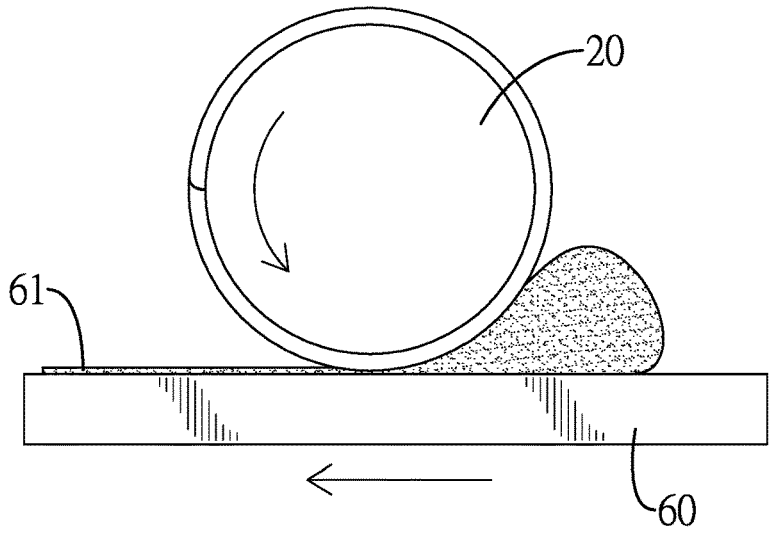
FIG. 5 is a side view of a wire bar of the coating device in FIG. 1, showing the wire bar rotated at a first rotational speed.
Figure 6:
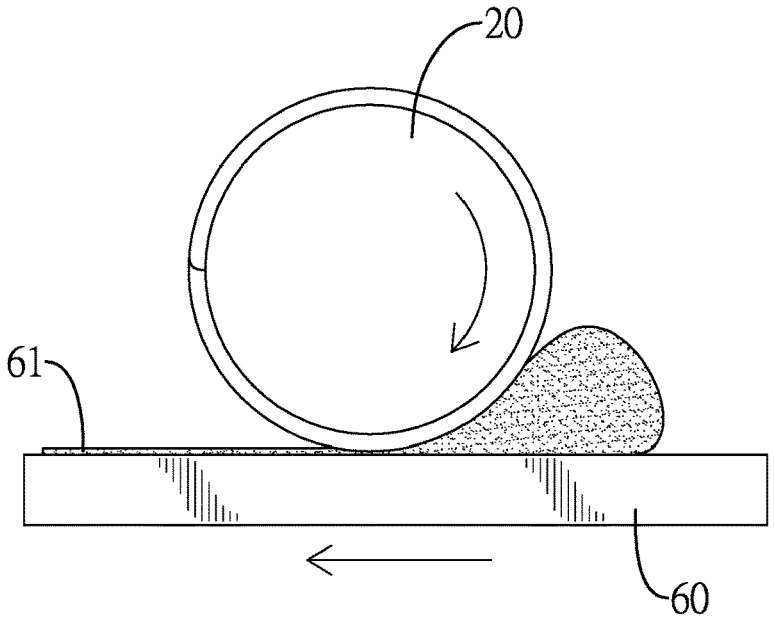
FIG. 6 is a side view of the wire bar of the coating device in FIG. 1, showing the wire bar rotated at a second rotational speed.
Figure 9:
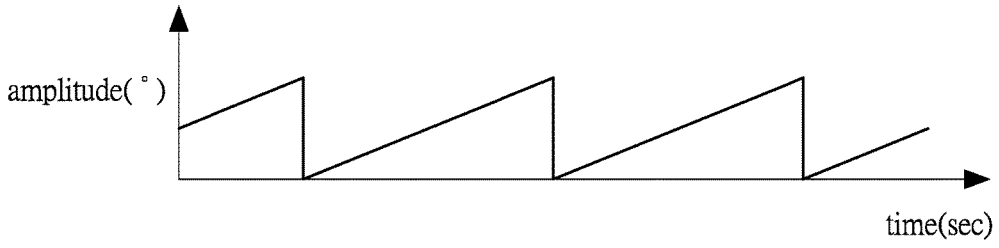
FIG. 9 is a waveform view of the wire bar of the coating device in FIG. 1, showing the wire bar rotated at the first rotational speed and the second rotational speed.

A coating method for using a coating device to coat a film 61 on a web 60 comprises a preparing step and a reciprocating rotating step. The preparing step comprises preparing a coating device. With reference to FIG. 5, a wire bar 20 of the coating device is rotated on the web 60 at a first rotational speed for coating the film 61 on the web 60. In a process of rotating the wire bar 20 at the first rotational speed, a tangential direction of the wire bar 20 at a connecting area between the wire bar 20 and the web 60 is opposite to a moving direction of the web 60. Then, the wire bar 20 of the coating device is rotated to an original position at a second rotational speed. In a process of rotating the wire bar 20 at the second rotational speed, the tangential direction of the wire bar 20 at the connecting area between the wire bar 20 and the web 60 is same to the moving direction of the web 60. The wire bar 20 is reciprocatingly rotated at the first rotational speed and the second rotational speed in the reciprocating rotating step. With reference to FIG. 9, the second rotational speed of the wire bar 20 is far faster than the first rotational speed of the wire bar 20. A rotating angle of the wire bar 20 is less than 3.6 degrees. Furthermore, the rotating angle of the wire bar 20 is 1 degree.

Figure 7:
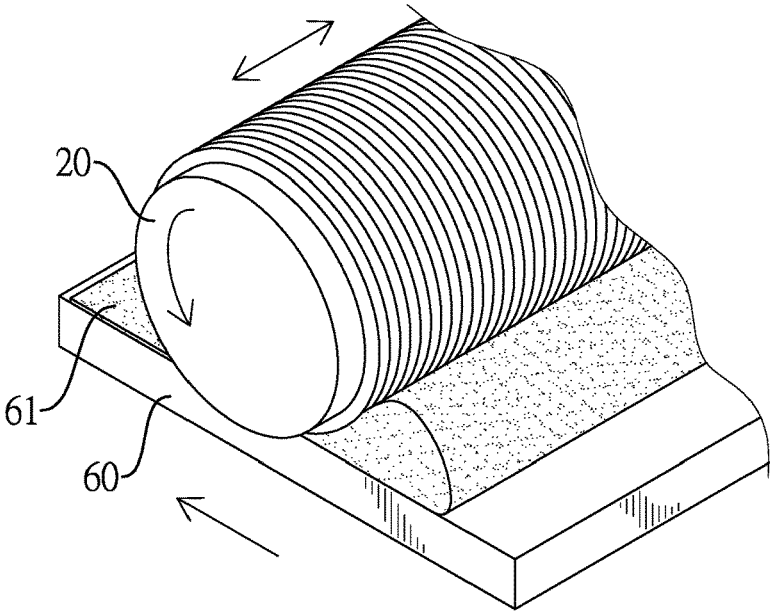
FIG. 7 is an enlarged perspective view of the wire bar of the coating device in FIG. 1, showing the wire bar rotated at the first rotational speed and in an axial movement.
Figure 8:
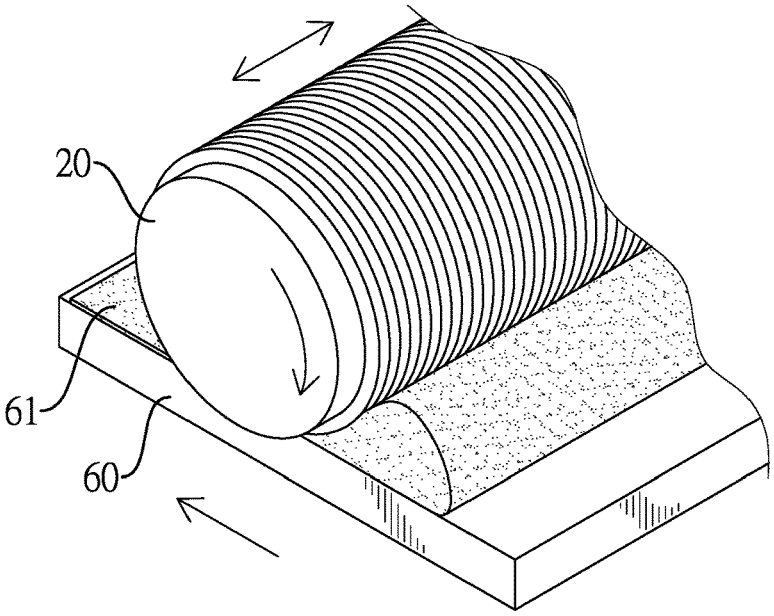
FIG. 8 is an enlarged perspective view of the wire bar of the coating device in FIG. 1, showing the wire bar rotated at the second rotational speed and in an axial movement.
Figure 10:
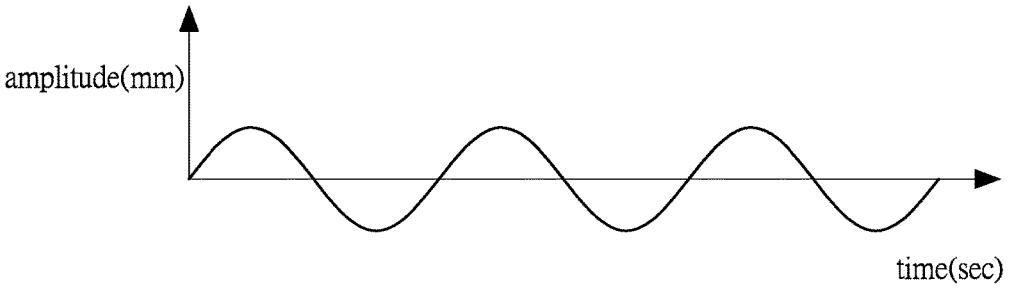
FIG. 10 is a waveform view of the wire bar of the coating device in FIG. 1, showing the wire bar rotated in the axial movement.
Figure 11:
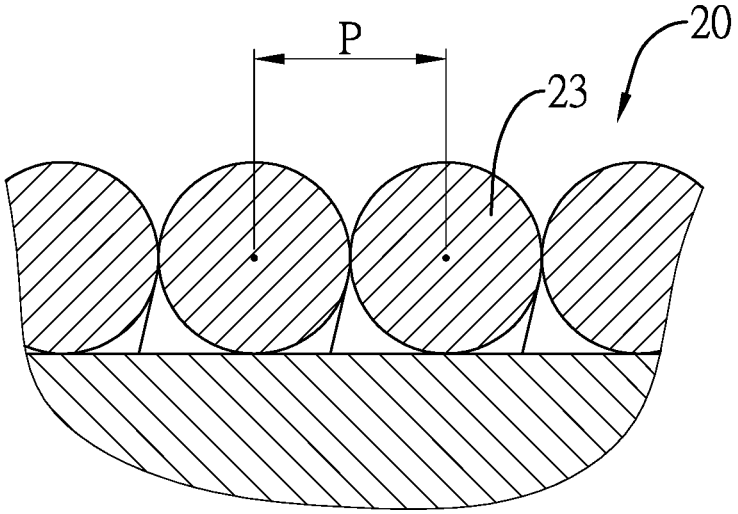
FIG. 11 is an enlarged cross sectional front side view of the wire bar of the coating device in FIG. 1.

With reference to FIGS. 7, 8, and 10, in the reciprocating rotating step, the wire bar 20 is rotated and axially moved simultaneously. A type of an axial movement of the wire bar 20 is simple harmonic motion. Moreover, the amplitude in a waveform in FIG. 10 is the axial movement distance of the wire bar. The preferred axial movement distance of the wire bar is 0.5 to 1 wire spacing P. With reference to FIG. 11, the wire spacing P is a distance between two axes of two adjacent coils of a wire wound on the wire bar 20. In the waveforms shown in FIGS. 9 and 10, the values of the frequency and the amplitude can be changed according to the operating needs.

With reference to FIGS. 1 to 4, a coating device for carrying out the coating method as described comprises a base 10, the wire bar 20, and a rotation adjusting module 30.

The base 10 has a first seat 11, a second seat 12, a first hairspring element 13, and a second hairspring element 14. The first seat 11 and the second seat 12 are disposed at a spaced interval. The first hairspring element 13 is disposed on the first seat 11. The second hairspring element 14 is disposed on the second seat 12. Each of the first hairspring element 13 and the second hairspring element 14 has an outer ring 15, a threaded portion 16, and a pushing surface 17. The threaded portion 16 is formed in the outer ring 15. The pushing surface 17 is formed on the threaded portion 16.

The wire bar 20 is disposed across the base 10. Furthermore, the wire bar 20 has a first end 21 and a second end 22. The first end 21 of the wire bar 20 is inserted into the threaded portion 16 of the first hairspring element 13. The second end 22 of the wire bar 20 is opposite the first end 21 of the wire bar 20 and is inserted into the threaded portion 16 of the second hairspring element 14.

The rotation adjusting module 30 is disposed on the base 10 and is connected to the wire bar 20 for driving the wire bar 20 to rotate reciprocatingly. The rotation adjusting module 30 has a first rotation adjusting element 31 and a second rotation adjusting element 32. The first rotation adjusting element 31 is disposed on the first seat 11 and is radially connected to the pushing surface 17 of the first hairspring element 13.

The second rotation adjusting element 32 is coacted with the first rotation adjusting element 31, is disposed on the second seat 12, and is radially connected to the pushing surface 17 of the second hairspring element 14. In addition, the first rotation adjusting element 31 and the second rotation adjusting element 32 are piezoelectric elements. Furthermore, the first rotation adjusting element 31 and the second rotation adjusting element 32 may be elements that can drive with short strokes, at high speeds, and at high frequencies, such as linear voice coil motors. In an embodiment of the coating device, the hairspring elements and the piezoelectric elements are co-operated for driving the wire bar 20 to rotate reciprocatingly. Moreover, the rotation adjusting module 30 may be a rotary voice coil motor for directly driving the wire bar 20 to rotate. The rotation adjusting module 30 may be a module that can drive with short strokes, at high speeds, and at high frequencies.

The coating device further has an axial movement adjusting module 40. The axial movement adjusting module 40 is disposed on the base 10. The axial movement adjusting module 40 is connected to and drives the wire bar 20 to move axially. The axial movement adjusting module 40 has a pushing element 41 and a restoring element 42. The pushing element 41 is disposed on the first seat 11 and is axially connected to the first end 21 of the wire bar 20. The restoring element 42 is disposed on the second seat 12 and is axially connected to the second end 22 of the wire bar 20. The pushing element 41 is a piezoelectric element. The restoring element 42 is a spring. In addition, the pushing element 41 may be an element that can drive with short strokes, at high speeds, and at high frequencies, such as a linear voice coil motor.

In addition, the coating device has an ink jet head 50. The ink jet head 50 is disposed on the wire bar 20.

The rotation adjusting module 30 drives the wire bar 20 to rotate reciprocatingly. The first rotation adjusting element 31 abuts and pushes the pushing surface 17 of the first hairspring element 13. In the meanwhile, the second rotation adjusting element 32 abuts and pushes the pushing surface 17 of the second hairspring element 14. The threaded portion 16 of the first hairspring element 13 and the threaded portion 16 of the second hairspring element 14 are co-rotated and drive the wire bar 20 to rotate at the first rotational speed. When the wire bar 20 is rotated to restore to the original position, the first rotation adjusting element 31 can release a pushing force applied on the pushing surface 17 of the first hairspring element 13. In the meanwhile, the second rotation adjusting element 32 can release a pushing force applied on the pushing surface 17 of the second hairspring element 14. The threaded portion 16 of the first hairspring element 13 and the threaded portion 16 of the second hairspring element 14 are rotated to restore to original positions and drive the wire bar 20 to rotate and restore to the original position quickly.

Figure 1:
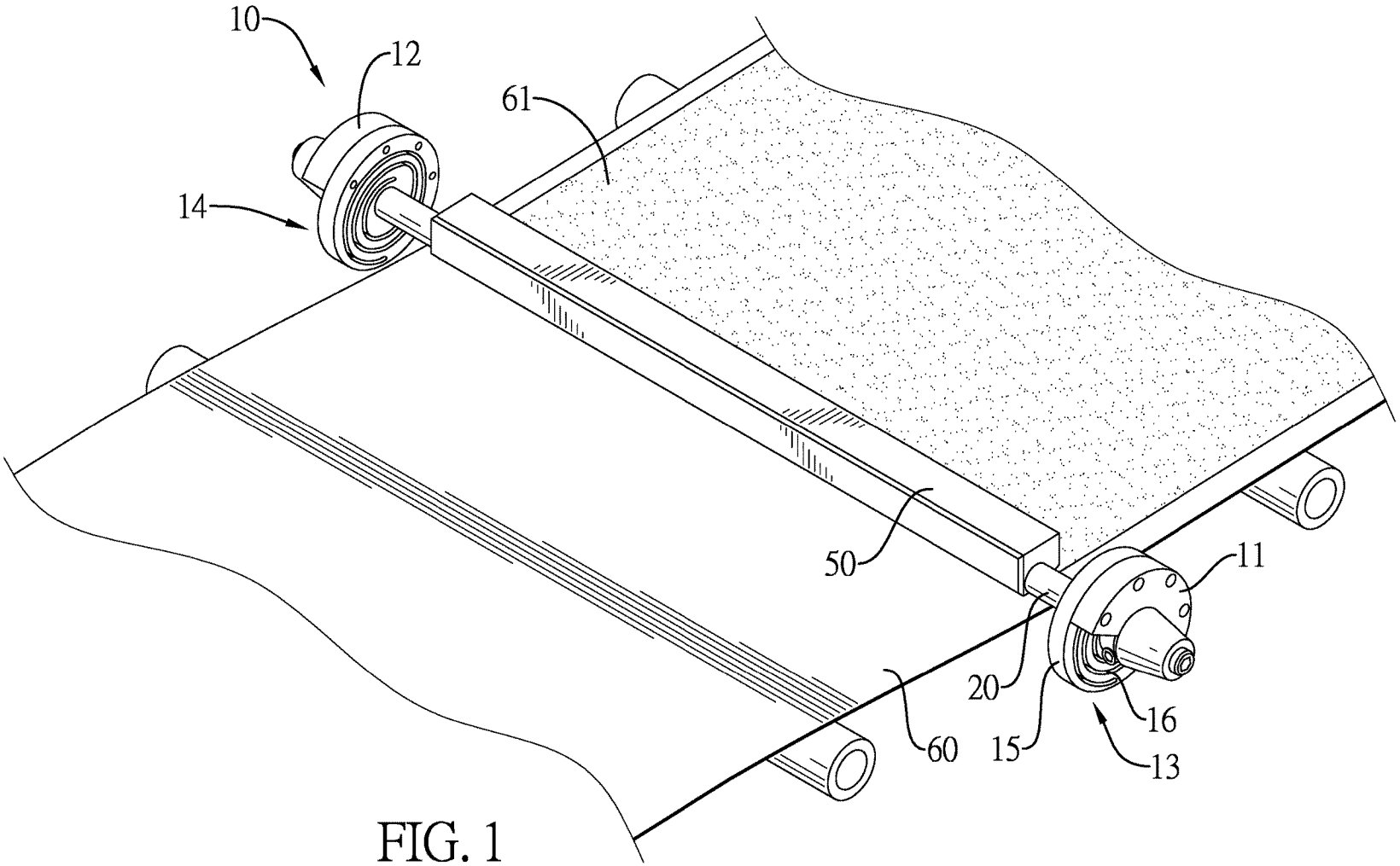
FIG. 1 is an operational perspective view of a coating device in accordance with the present invention.
Figure 2:
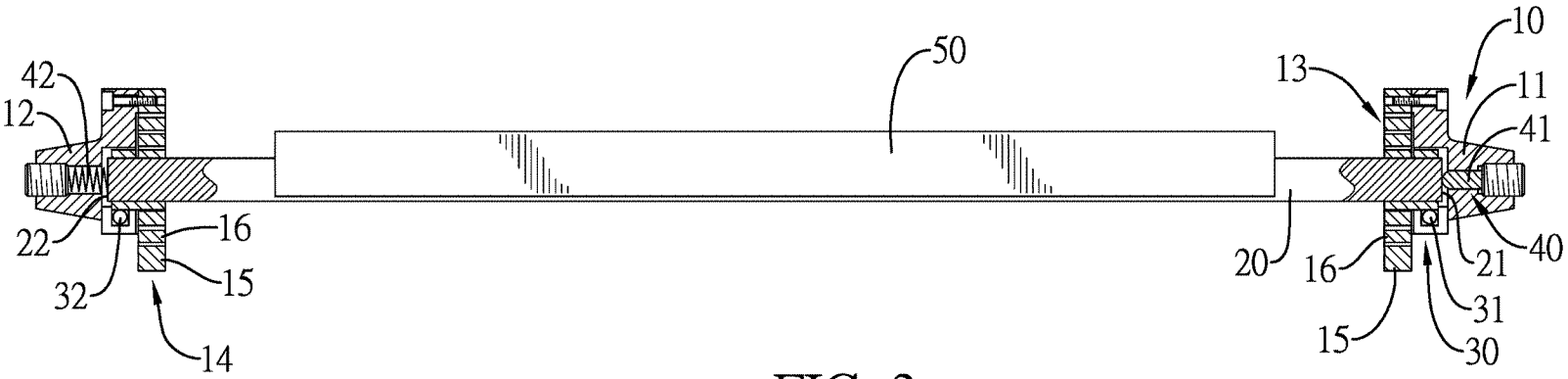
FIG. 2 is a cross sectional front side view of the coating device in FIG. 1.
Figure 3:
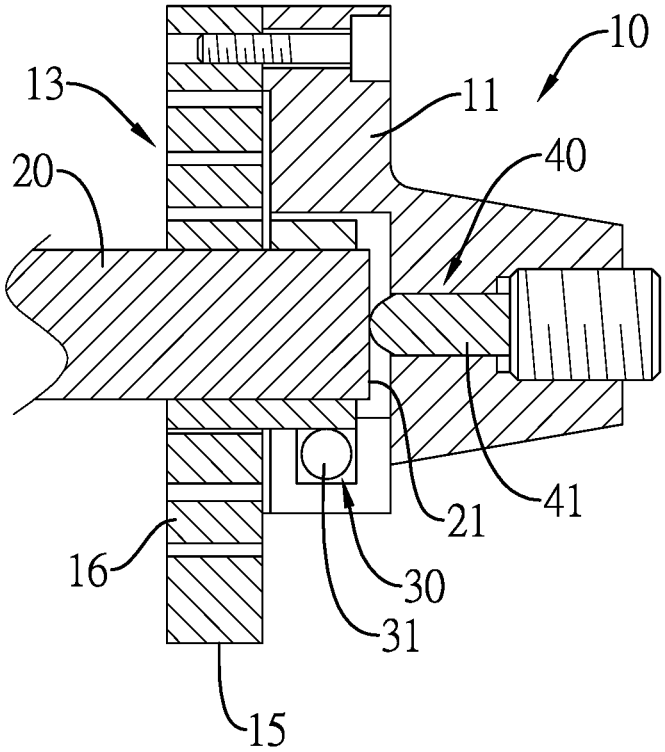
FIG. 3 is an enlarged front side view of the coating device in FIG. 2.
Figure 4:
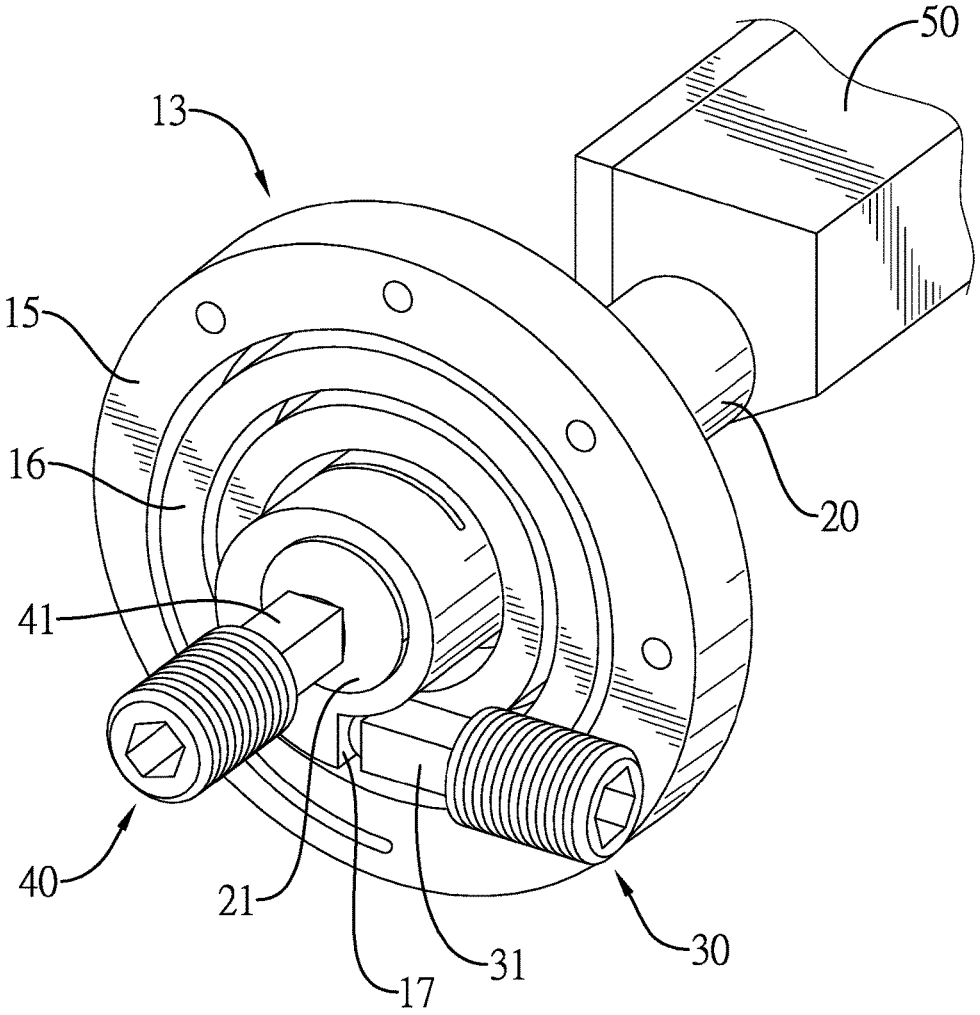
FIG. 4 is an enlarged perspective view of the coating device in FIG. 1.

With reference to FIGS. 2, 7, and 8, the wire bar 20 driven by the rotation adjusting module 30 is rotated reciprocatingly. The wire bar 20 is pushed by the pushing element 41 of the axial movement adjusting module 40 to move toward the second seat 12. The restoring element 42 is compressed by the wire bar 20. The pushing element 41 releases the pushing force forced on the wire bar 20. The resilience of the restoring element 42 can be applied to the wire bar 20, and the wire bar 20 moves to restore to the original position.

In addition, the coating device may have a single wire bar 20 or multiple wire bars 20.

Accordingly, in the coating method, the wire bar 20 is driven by the rotation adjusting module 30 for rotating reciprocatingly. The wire bar 20 is rotated at the first rotational speed and then at the second rotational speed. The wire bar 20 is rotated reciprocatingly for the rotating angle but not for 360 degrees, so as to increase a connecting area between the wire bar 20 and the film 61. The precision requirements on the straightness and the cylindricity of the wire bar 20 are decreased. In addition, the wire bar 20 is rotated at the first rotational speed, and the tangential direction of the wire bar 20 at the connecting area between the wire bar 20 and the film 61 is opposite to the moving direction of the film 61. The relative speed between the wire bar 20 and the film 61 is increased. On the premise that the thickness of the film 61 is controlled accurately, the coating speed of the wire bar 20 can be decreased for controlling the output of the coating operation.

Furthermore, the wire bar 20 is rotated at the second rotational speed to restore to the original position quickly, and the second rotational speed of the wire bar 20 is far faster than the first rotational speed of the wire bar 20. The ink can be driven by the wire bar 20 to splash at a high speed. The spreading effect and the uniformity of the compounds in the ink are increased. On the premise of the thickness of the film 61, the wire bar 20 can be rotated to restore to the original position and the web 60 coated with the film 61 can be sent to a subsequent coating process.

In addition, the axial movement adjusting module 40 drives the wire bar 20 to move axially. The wire bar 20 can be rotated reciprocatingly and move axially and reciprocatingly in the coating method. Under the co-action effect of the reciprocating rotation and the reciprocating axially movement, the compounds in the ink are stirred by the wire bar 20 to prevent the compounds from aggregating.

Moreover, the rotation adjusting module 30 may co-work with the first hairspring element 13 and the second hairspring element 14 to achieve the two-way rotation. The axial movement adjusting module 40 may co-work with the first hairspring element 13 and the second hairspring element 14 to achieve the two-way movement. The stability of the wire bar 20 is increased by the first hairspring element 13 and the second hairspring element 14.

What is claimed is:

1. A coating method for coating a film on a web, the coating method comprising steps of:

a preparing step comprising preparing a coating device; and a reciprocating rotating step comprising rotating a wire bar of the coating device on the web at a first rotational speed for coating the film on the web, and in a process of rotating the wire bar at the first rotational speed, a tangential direction of the wire bar at a connecting area between the wire bar and the web being opposite to a moving direction of the web, and then the wire bar of the coating device rotated to restore to an original position at a second rotational speed, and in a process of rotating the wire bar at the second rotational speed, the tangential direction of the wire bar at the connecting area between the wire bar and the web being same to the moving direction of the web, and the second rotational speed of the wire bar being faster than the first rotational speed of the wire bar.

2. The coating method as claimed in claim 1, wherein in the reciprocating rotating step, the wire bar is rotated and axially moved simultaneously.

3. The coating method as claimed in claim 2, wherein in the reciprocating rotating step, a type of an axial movement of the wire bar is simple harmonic motion.

4. The coating method as claimed in claim 2, wherein an axial movement distance of the wire bar is 0.5 to 1 wire spacing.

5. The coating method as claimed in claim 3, wherein the axial movement distance of the wire bar is 0.5 to 1 wire spacing.

6. The coating method as claimed in claim 1, wherein a rotating angle of the wire bar is less than 3.6 degrees.

7. The coating method as claimed in claim 2, wherein a rotating angle of the wire bar is less than 3.6 degrees.

8. The coating method as claimed in claim 3, wherein a rotating angle of the wire bar is less than 3.6 degrees.

9. The coating method as claimed in claim 4, wherein a rotating angle of the wire bar is less than 3.6 degrees.

10. The coating method as claimed in claim 5, wherein a rotating angle of the wire bar is less than 3.6 degrees.

* * * * *